US011114781B1

(12) United States Patent
Wankoff et al.

(10) Patent No.: US 11,114,781 B1
(45) Date of Patent: Sep. 7, 2021

(54) SEALED FLEXIBLE PRINTED CIRCUIT CONNECTOR

(71) Applicant: Apple Inc., Cupertino, CA (US)

(72) Inventors: Eric B. Wankoff, San Francisco, CA (US); Mahmoud R. Amini, Sunnyvale, CA (US); Peter J. Cameron, Scotts Valley, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/884,913

(22) Filed: May 27, 2020

(51) Int. Cl.
*H01R 12/61* (2011.01)
*H01R 12/70* (2011.01)

(52) U.S. Cl.
CPC ..... *H01R 12/613* (2013.01); *H01R 12/7023* (2013.01); *H01R 12/7058* (2013.01)

(58) Field of Classification Search
CPC ..... H01R 12/613; H01R 12/7058; H01R 12/7023; H01R 12/71; H01R 12/77; H01R 12/79; H01R 12/7011; H01R 12/7052; H01R 12/7005; H01R 12/61; H01R 12/62; H01R 12/63; H01R 13/5219; H01R 13/5202
USPC ..... 439/65, 62, 67, 329, 492
See application file for complete search history.

(56) References Cited

U.S. PATENT DOCUMENTS

| | | | | |
|---|---|---|---|---|
| 8,241,051 | B2 * | 8/2012 | Yi | H01R 13/6599 439/271 |
| 8,579,654 | B2 * | 11/2013 | Chen | H01R 12/61 439/495 |
| 9,136,616 | B2 * | 9/2015 | Zhao | H01R 13/5219 |
| 9,209,540 | B2 | 12/2015 | Raff | |
| 9,225,115 | B2 | 12/2015 | Malek | |
| 2004/0157476 | A1 * | 8/2004 | Maldonado | H01R 13/5202 439/66 |
| 2014/0038458 | A1 * | 2/2014 | Bausch | H01R 13/22 439/587 |
| 2015/0222062 | A1 | 8/2015 | Sloey | |
| 2020/0266566 | A1 * | 8/2020 | Shimada | H01R 12/79 |

* cited by examiner

*Primary Examiner* — Travis S Chambers
(74) *Attorney, Agent, or Firm* — Kilpatrick Townsend & Stockton LLP

(57) ABSTRACT

Connectors for connecting traces on one or more flexible circuit boards to traces on a printed circuit board. These connectors can include gaskets, potting material, and other structures or materials to seal electrical connections in the connector from moisture ingress to prevent damage. The connectors can be locked to secure the one or more flexible circuit board in place in the connector. The connectors can be unlocked and then opened to remove the flexible circuit boards to remove components or to rework the electronic device.

24 Claims, 17 Drawing Sheets

SEALED FLEXIBLE PRINTED CIRCUIT CONNECTOR

BACKGROUND

Electronic devices are continuously becoming more complicated and are packing an ever increasing amount of functionality. To support this increasing amount of functionality, electronic devices can include a number of various types of boards, such as flexible circuit boards, printed circuit boards, and other types of boards. These boards can require a correspondingly increasing number of interconnect paths between and among them. Accordingly, it can be desirable to provide connectors that provide a large number of connections between boards, such as a printed circuit board and a flexible circuit board.

During assembly of the electronic device, conventional connectors can be mated to both the flexible circuit board and the printed circuit board. But a complicated assembly procedure can result in component damage and the need to rework or scrap portions of the electronic device. To avoid this damage, it can be desirable that connectors readily connect a flexible circuit board to a printed circuit board. It can also be desirable that these boards can be easily disconnected in the event rework is still necessary. This ability can also allow servicing of components that fail or need replaced, which can extend the life of the electronic device.

These electronic devices can be portable or otherwise movable during their lifetime. As a result, they can be dropped or otherwise exposed to sudden, physically jarring events. When severe enough, these events can cause inadvertent disconnections between a flexible circuit board and a printed circuit board. It can therefore be desirable that these connectors securely connect the flexible circuit board to the printed circuit board, such that a connection can be maintained during the lifetime of the electronic device, despite the occurrence of such events.

Also, when these electronic devices are dropped, they are sometimes dropped into water or other liquids, thereby allowing water or moisture in the electronic device. Moisture can also enter an electronic device when liquids are spilled, or when an electronic device is exposed to harsh environments, such as rain or sweat exposure from contact with skin during exercise. Accordingly, it can be desirable that these connectors be water resistant.

These electronic devices can be manufactured in large numbers. It can therefore be desirable that these connectors be readily manufactured such that constraints on electronic device assembly are avoided.

Thus, what is needed are connectors that can easily and securely connect a flexible circuit board to a printed circuit board, are water and moisture resistant, and are readily manufactured.

SUMMARY

Accordingly, embodiments of the present invention can provide connectors that can easily and securely connect a flexible circuit board to a printed circuit board, are water and moisture resistant, and are readily manufactured. An illustrative embodiment of the present invention can provide connectors that easily connect a flexible circuit board to a printed circuit board. The connector can include a housing having one or more alignment features that are arranged to fit with one or more corresponding cutouts on a flexible circuit board such that the flexible circuit board can be accurately aligned to the housing. This in turn can accurately align contacting portions of contacts supported by the housing to contacts on the flexible circuit board such that reliable electrical connections are formed.

These and other embodiments of the present invention can provide connectors that provide a secure connection between a flexible circuit board and a printed circuit board. The connector can include a cover that closes to hold the flexible circuit board in place in the connector. The cover can include a recessed tray portion that can provide a force against the flexible circuit board to hold the flexible circuit board in place when the cover is closed. The cover can include tabs that fit under prongs to lock the cover in place to help prevent accidental disconnections between the flexible circuit board and the printed circuit board, for example after a drop event or other physical shock. The cover can be opened with a non-destructive procedure to provide the ability to rework portions of the electronic device during or after assembly.

These and other embodiments of the present invention can provide connectors that are water and moisture resistant. These connectors can employ seals or gaskets around the contacting portions of the contacts supported by the housing. A gasket can be located between a housing of the connector and a flexible circuit board when the flexible circuit board is connected by the connector. The gasket can be placed in a groove in a top surface of the housing and the gasket can include one or more concentric ribs to improve its sealing capability.

These and other embodiments of the present invention can provide connectors that are readily assembled. For example, a cover for a connector can include stamped features that form tabs that help to lock the cover in place, as well as dimples that can act as pivot structure to allow the cover to open and close. The pivot structures can fit in recesses or detents in sides of the housing to keep the cover attached to the housing. The detents can each include a forward recess and a rear recess, the forward recess separated from the rear recess by a raised portion. A shell portion can include arms along the sides of the housing, where the arms terminate in prongs. The tabs of the cover can fit under the prongs to hold the cover in a locked position. The prongs can each be part of a fork, where the fork include a slot and the tabs of the cover can fit in the slots in the forks to lock the cover in place.

These and other embodiments of the present invention can provide connectors that can be opened and closed. For example, a connector can be opened by moving a cover forward relative to a housing. As this happens, dimples or other pivot structures can move from rear recesses to forward recesses in detents in sides of housing. The tabs can emerge from under the prongs at ends of arms on a shell of the connector. The cover can then rotate away from the housing exposing the top surface of the housing. With the cover in this open position, a flexible circuit board can be removed (for example for rework) or inserted. The flexible circuit board can include cutouts that fit with alignment features on a top surface of the housing. The cover can then be closed by rotating the cover towards the housing. The cover can then be locked in position by moving the cover backward relative the housing. As this happens, the dimples or other pivot structures can move from forward recesses to rear recesses in detents in sides of housing. The tabs can fit under the prongs at ends of arms on a shell of the connector. The cover can then be in the locked position against the housing.

These and other embodiments of the present invention can provide connectors that can connect two or more flexible circuit boards to a printed circuit board. A housing of a connector can support two sets of contacts. Contacting portions of each set of contacts can be exposed at openings in a top surface. Individual gaskets can laterally surround each set of contacting portions. Alignment features can be included on the top surface of the housing to align separate flexible circuit boards with each set of contacting portions. A cover can be closed and locked as before to secure the multiple flexible circuit boards in place in the connector. This concept can be extended to three or more flexible circuit boards.

In these and other embodiments of the present invention, contacts, shells, covers, and other conductive portions of a connector can be formed by stamping, metal-injection molding, machining, micro-machining, 3-D printing, forging, drawing, or other manufacturing process. The conductive portions can be formed of stainless steel, steel, copper, copper titanium, phosphor bronze, or other material or combination of materials. They can be plated or coated with nickel, gold, or other material. The nonconductive portions, such as the housings, can be formed using injection or other molding, 3-D printing, machining, or other manufacturing process. The nonconductive portions can be formed of silicon or silicone, rubber, hard rubber, plastic, nylon, liquid-crystal polymers (LCPs), or other nonconductive material or combination of materials.

These and other embodiments of the present invention can provide connectors that can be located in various types of devices, such as portable computing devices, tablet computers, desktop computers, laptops, all-in-one computers, cell phones, wearable-computing devices, storage devices, portable media players, navigation systems, monitors, power supplies, adapters, remote control devices, audio devices, chargers, and other devices. These connectors can provide pathways for signals that are compliant with various standards such as Universal Serial Bus (USB), a High-Definition Multimedia Interface (HDMI), Digital Visual Interface (DVI), power, Ethernet, DisplayPort, Thunderbolt, Lightning and other types of standard and non-standard interfaces that have been developed, are being developed, or will be developed in the future.

Various embodiments of the present invention can incorporate one or more of these and the other features described herein. A better understanding of the nature and advantages of the present invention can be gained by reference to the following detailed description and the accompanying drawings.

DESCRIPTION OF ILLUSTRATIVE EMBODIMENTS

Figure 1:
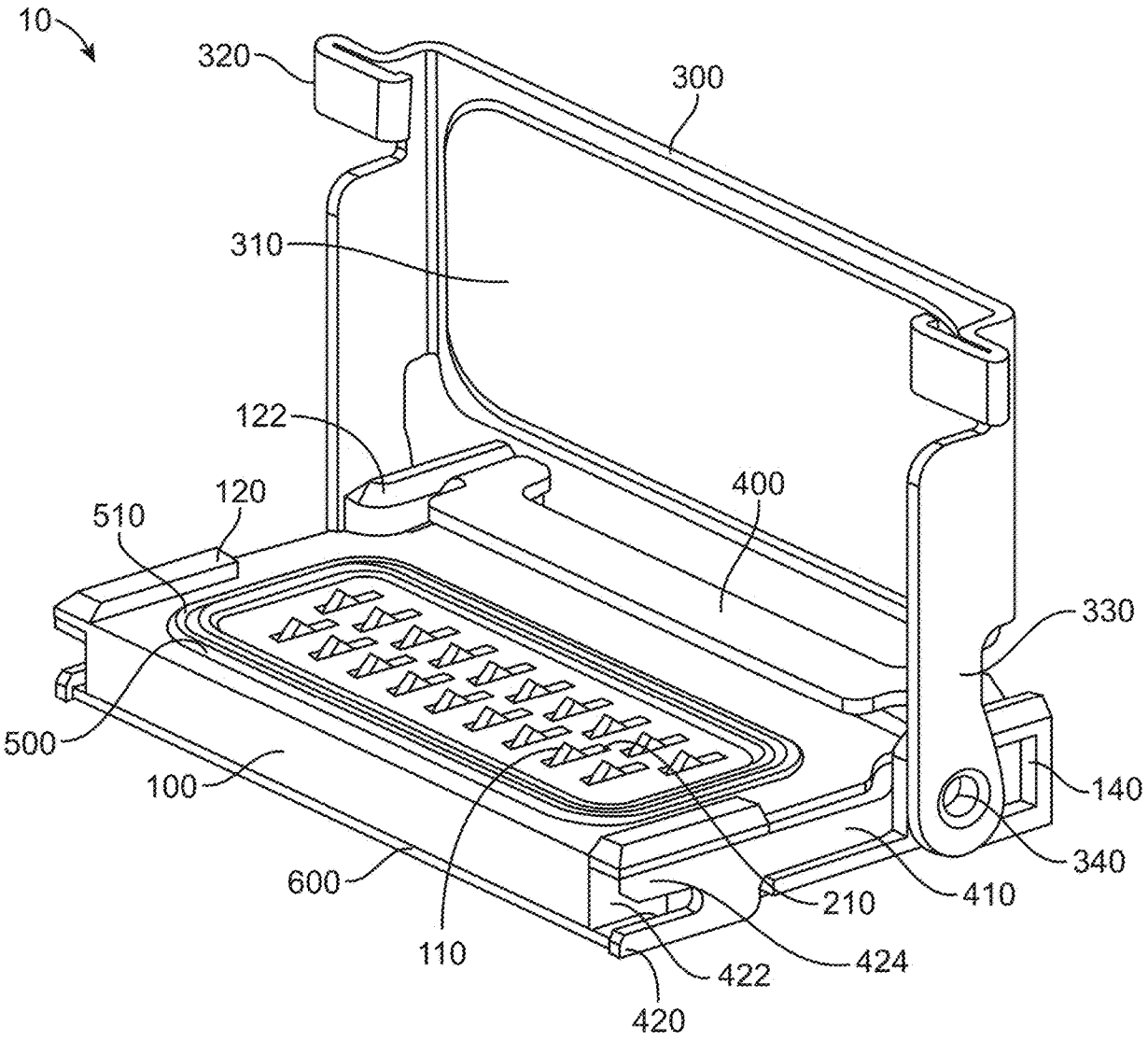
FIG. 1 illustrates a connector according to an embodiment of the present invention.

FIG. 1 illustrates a connector according to an embodiment of the present invention. This figure, as with the other included figures, is shown for illustrative purposes and does not limit either the possible embodiments of the present invention or the claims.

In this example, connector 10 is shown in an open state. Connector 10 can be used to connect a flexible circuit board, such as flexible circuit board 700 (shown in FIG. 7), to a printed circuit board, such as printed circuit board 810 (shown in FIG. 6.) For example, traces 750 (shown in FIG. 7) can connect circuitry and components in an electronic device (not shown) housing connector 10 to contacts 760 (shown in FIG. 7) on flexible circuit board 700. Contacts 760 can physically and electrically connect to contacting portions 210 of contacts 200 (shown in FIG. 4.) Contacts 200 can include surface-mount contacting portions 220 (shown in FIG. 4), which can be soldered to pads 820 (shown in FIG. 6) of printed circuit board 810. Printed circuit board 810 can include traces that connect pads 820 to other circuitry and components in the electronic device housing connector 10.

Contacting portions 210 of contacts 200 can emerge from housing 100 at openings 110. Openings 110 and contacting portions 210 can be laterally surrounded by gasket 500. Gasket 500 can include one or more raised ribs 510 that can extend circumferentially along gasket 500. Ribs 510 can help to improve the moisture resistance provided by gasket 500. Housing 100 can further include one or more alignment features including alignment feature 120 and alignment feature 122. Alignment feature 120 and alignment feature 122 can aligned with cutouts 710 (shown in FIG. 7) and other features on flexible circuit board 700 such that contacts 760 can accurately align to contacting portions 210.

Shell 400 can include arms 410. Arms 410 can terminate in forks 420. Forks 420 can include slots 422 and prongs 424. That is, arms 410 can terminate in prongs 424. Cover 300 can include recessed top portion 310 and tabs 320. Cover 300 can further include arms 330, which can terminate in pivot structures, which in this particular example can be dimples 340. Dimples 340 can be located in detents 140 on each side of housing 100. Housing 100 can be supported by bottom covering 600.

Tabs 320 and forks 420 can provide mechanisms for locking cover 300 to housing 100. An example is shown in the following figures.

Figure 2:
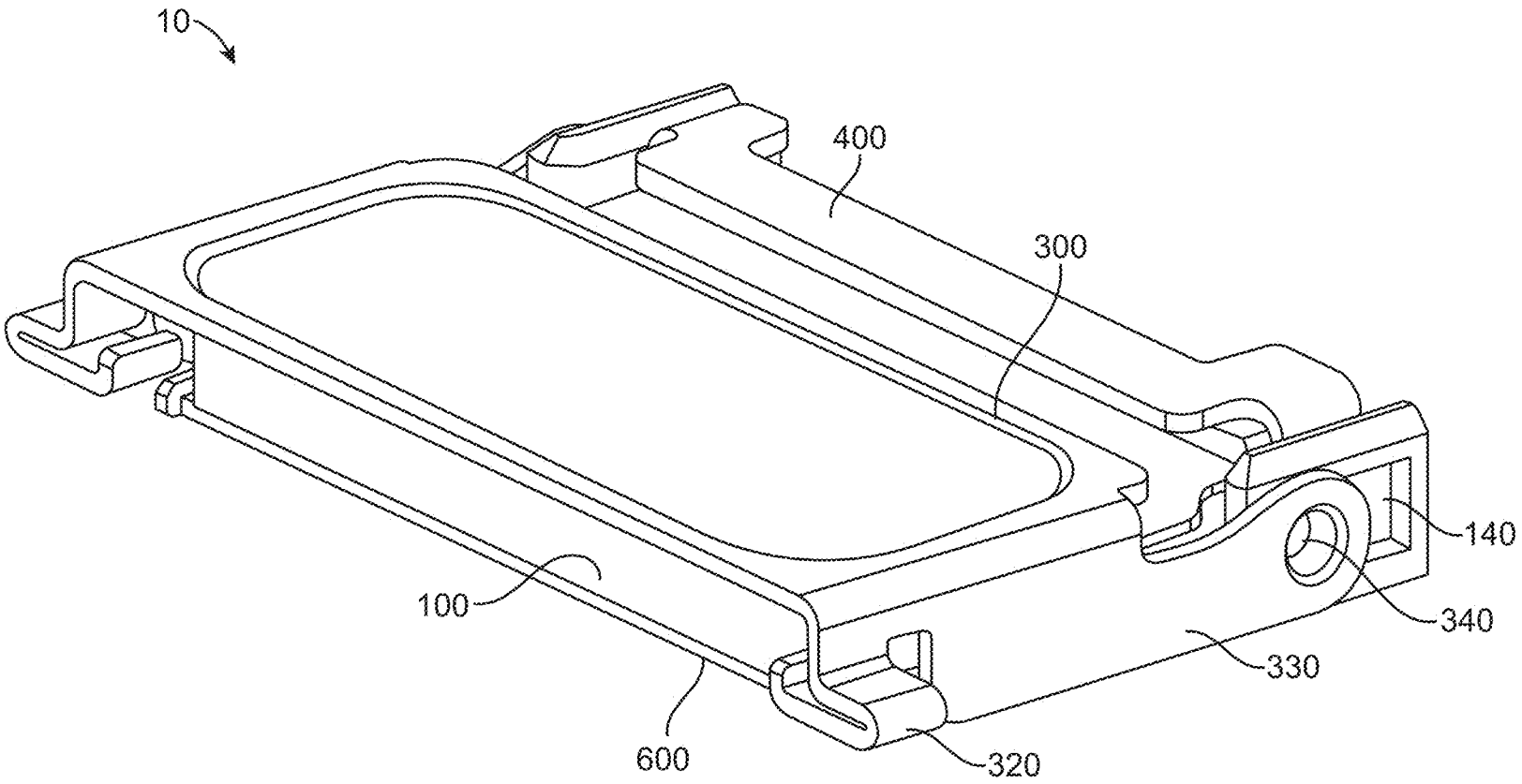
FIG. 2 illustrates the connector of FIG. 1 in a closed state.

FIG. 2 illustrates the connector of FIG. 1 in a closed state. In this example, cover 300 of connector 10 can lie flat on a top surface of housing 100. Cover 300 can be positioned forward relative to housing 100. Specifically, cover 300 can include arms 330 terminating in pivot structures, shown here as dimples 340. Dimples 340 can be located in forward recess 146 (shown in FIG. 9) of detent 140. Tabs 320 can be clear of forks 420 (shown in FIG. 1) of shell 400. As before, housing 100 can be supported by bottom covering 600.

Figure 3:
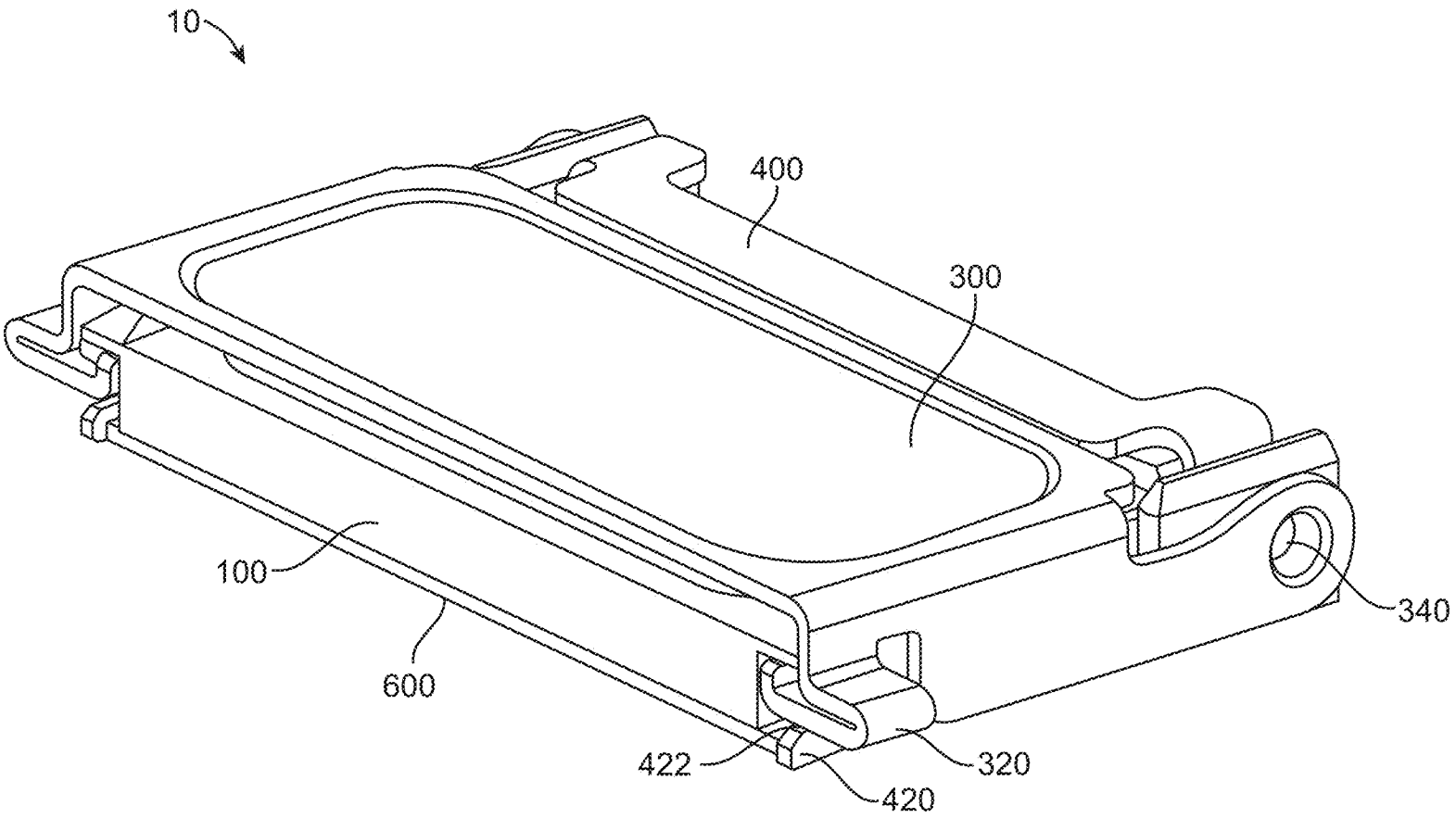
FIG. 3 illustrates the connector of FIG. 1 in a locked state.

FIG. 3 illustrates the connector of FIG. 1 in a locked state. In this example, cover 300 of connector 10 has been moved backward relative to housing 100. Specifically, dimples 340 have been pushed backward into rear recess 144 of detent 140 (both shown in FIG. 9.) Tabs 320 can be fit in slots 422 of forks 420 of shell 400, thereby locking cover 300 in place relative to housing 100. As before, housing 100 can be supported by bottom covering 600.

Connector 10 can be assembled in various ways. One example is shown in the following figures.

Figure 4:
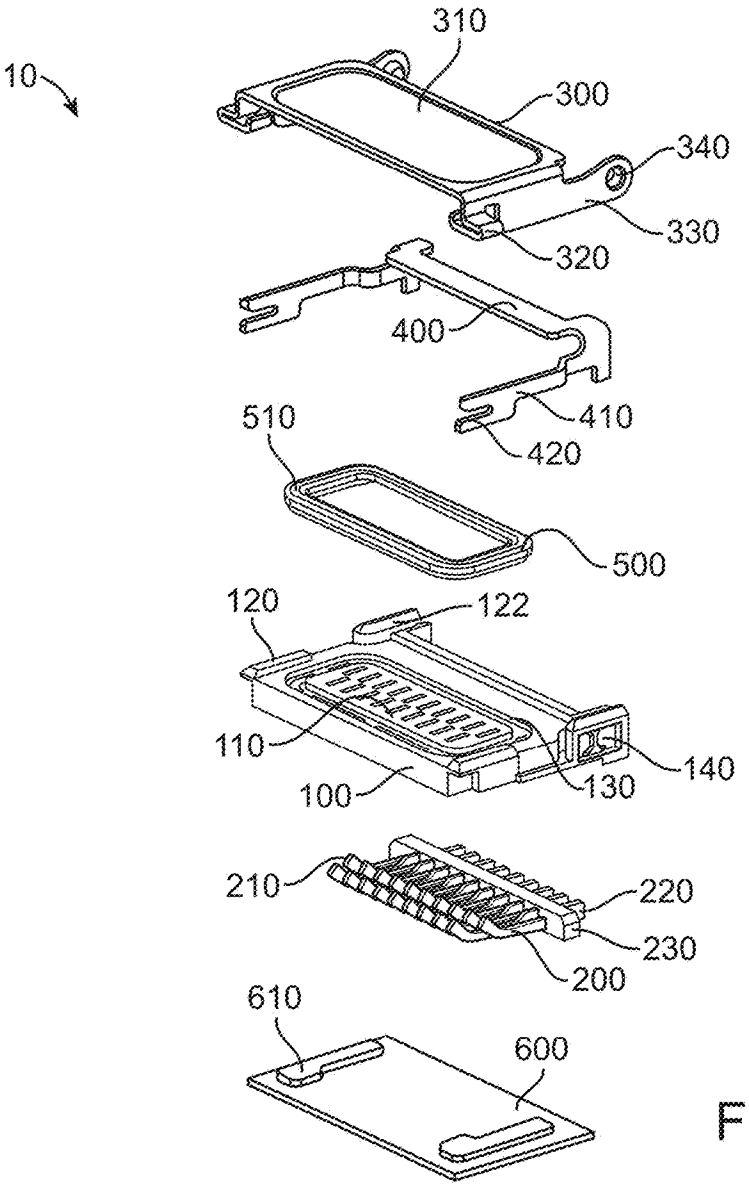
FIG. 4 is an exploded view of the connector FIG. 1.

FIG. 4 is an exploded view of the connector FIG. 1. In this example, housing 100 can include a number of openings 110 in a top surface. The top surface of housing 100 can further include one or more alignment features, such as alignment feature 120 and alignment feature 122, as well as groove 130. Detents 140 can be located in sides of housing 100. Contacts 200 can include contacting portions 210 that can emerge from housing 100 through openings 110. Contacts 200 can be held together by housing 230. Housing 230 can be injection molded around contacts 200. Contacts 200 can further include surface-mount contacting portions 220. In these and other embodiments of the present invention, contacts 200 can include through hole contacting portions, or a mix of surface-mount contacting portions and through hole contacting portions. Contacts 200 can be protected by bottom cover 600. Bottom cover 600 can include alignment features 610 that fit with corresponding features (not shown) of housing 100 to align bottom cover 600 to an underside of housing 100. Bottom covering 600 can be fastened or fixed to housing 100 using adhesives or other materials or techniques.

Gasket 500 can fit in groove 130 in housing 100. Alternatively, gasket 500 can be insert molded in place on housing 100. Gasket 500 can act as a face shield and can include one or more ribs 510 on a top and bottom surface. Ribs 510 can help to improve the moisture resistance provided by gasket 500. Shell 400 can be located around a rear portion and sides of housing 100. Shell 400 can include arms 410 that terminate in forks 420. Cover 300 can include a recessed top portion 310. Recessed top portion 310 can provide a proper surface to engage flexible circuit board 700 (shown in FIG. 7.) That is, recessed top portion 310 can be substantially free of sharp edges or burrs that could damage flexible circuit board 700. Cover 300 can include arms 330 that terminate in pivot structures, shown here as dimples 340. Cover 300 can further include tabs 320.

Connectors provided by embodiments of the present invention can open to accept a flexible circuit board, and then close and lock to secure the flexible circuit board in place in the connector. Examples are shown in the following figures.

Figure 5C:
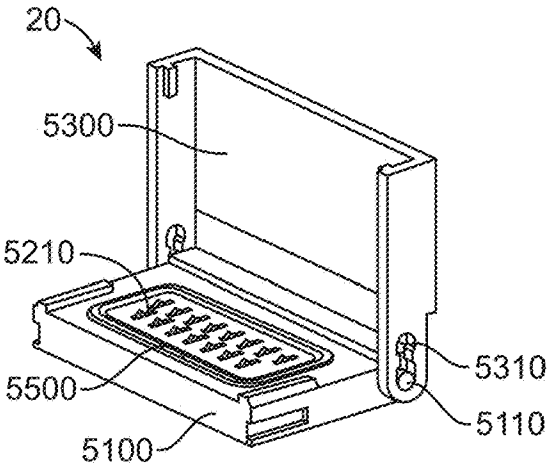
FIGS. 5A through 5F illustrates a connector being opened, then closed and locked according to an embodiment of the present invention.
Figure 5B:
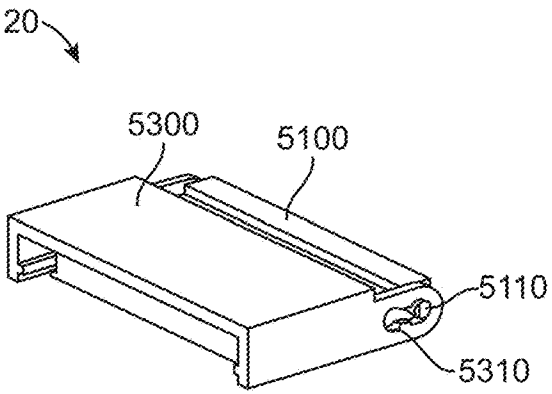
Figure 5A:
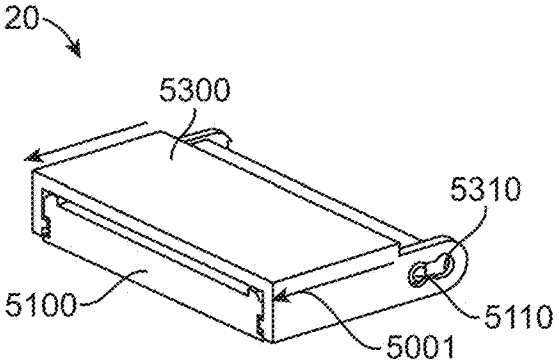

FIGS. 5A through 5F illustrates a connector being opened, then closed and locked according to an embodiment of the present invention. In FIG. 5A, cover 5300 of connector 20 can moved forward in a direction 5001 relative to housing 5100. Housing 5100 can include pins 5110 that can reside in openings 5310 in cover 5300. In FIG. 5B, pins 5110 of housing 5100 have been moved to rear of openings 5310 in cover 5300. In this configuration, cover 5300 of connector 20 can be opened, as shown in FIG. 5C. In FIG. 5C, cover 5300 of connector 20 has been opened thereby exposing contacting portions 5210 at a top surface of housing 5100. Gasket 5500 can laterally surround contacting portions 5210. Pins 5110 of housing 5100 can remain in a back of opening 5310 in cover 5300.

Figure 5F:
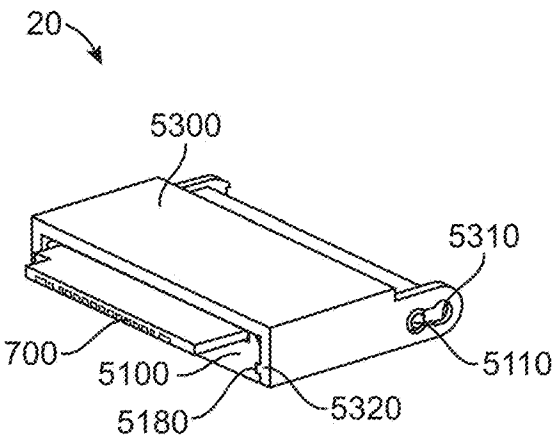
Figure 5E:
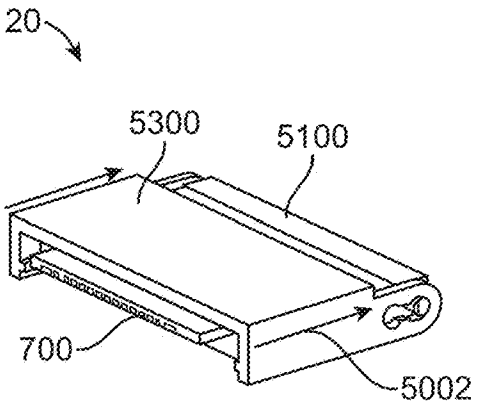
Figure 5D:
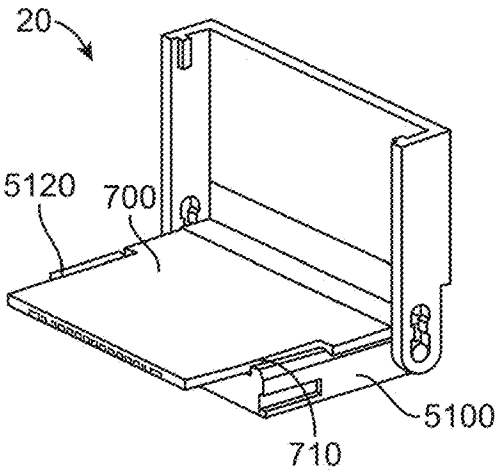

In FIG. 5D, flexible circuit board 700 can be placed on housing 5100 of connector 20. Flexible circuit board 700 can include cutout 710 that can fit with alignment features 5120. In FIG. 5E, cover 5300 can be closed against a top surface of flexible circuit board 700. Cover 5300 can then be moved backward in a direction 5002 relative to housing 5100. In FIG. 5F, cover 5300 can be locked in place relative to housing 5100 to secure flexible circuit board 700. Pin 5110 can be located in a front of opening 5310 in cover 5300. Tabs 5320 of cover 5300 can fit in notch 5180 on each side of housing 5100 to lock cover 5300 in place relative to housing 5100.

In these and other embodiments of the present invention, gaskets 500 can improve the moisture resistance of connector 10. In these and other embodiments of the present invention, other steps, such as potting, can be used to further improve moisture resistance of connector 10. An example is shown in the following figure.

Figure 6:
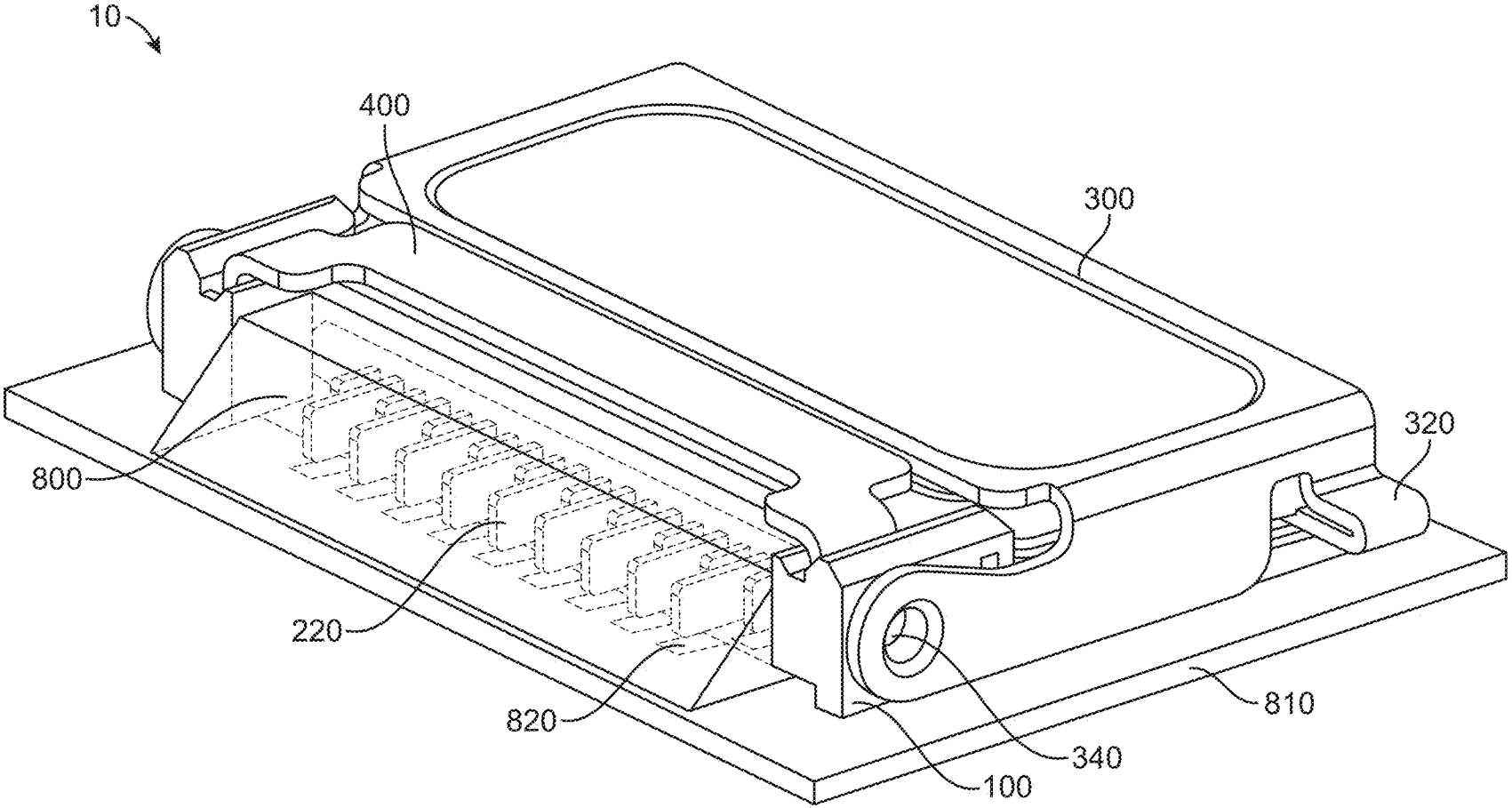
FIG. 6 illustrates a back view of the connector of FIG. 1.

FIG. 6 illustrates a back view of the connector of FIG. 1. In this example, cover 300 can be locked in place against housing 100. Specifically, tabs 320 of cover 300 can be located in slots 422 of forks 420 (both shown in FIG. 1) of shell 400. Dimples 340 can be located in rear recess 144 of detent 140 (both shown in FIG. 9) in housing 100. Contacts 200 (shown in FIG. 4) can include surface-mount contacting portions 220, which can be soldered to pads 820 on printed circuit board 810. To protect surface-mount contacting portions 220 from moisture that can ingress into an electronic device (not shown) housing connector 10, a rear portion of connector 10 can be covered with potting material 800. Potting material 800 can be an epoxy, polyurethane, or other adhesive or elastomer.

Figure 7:
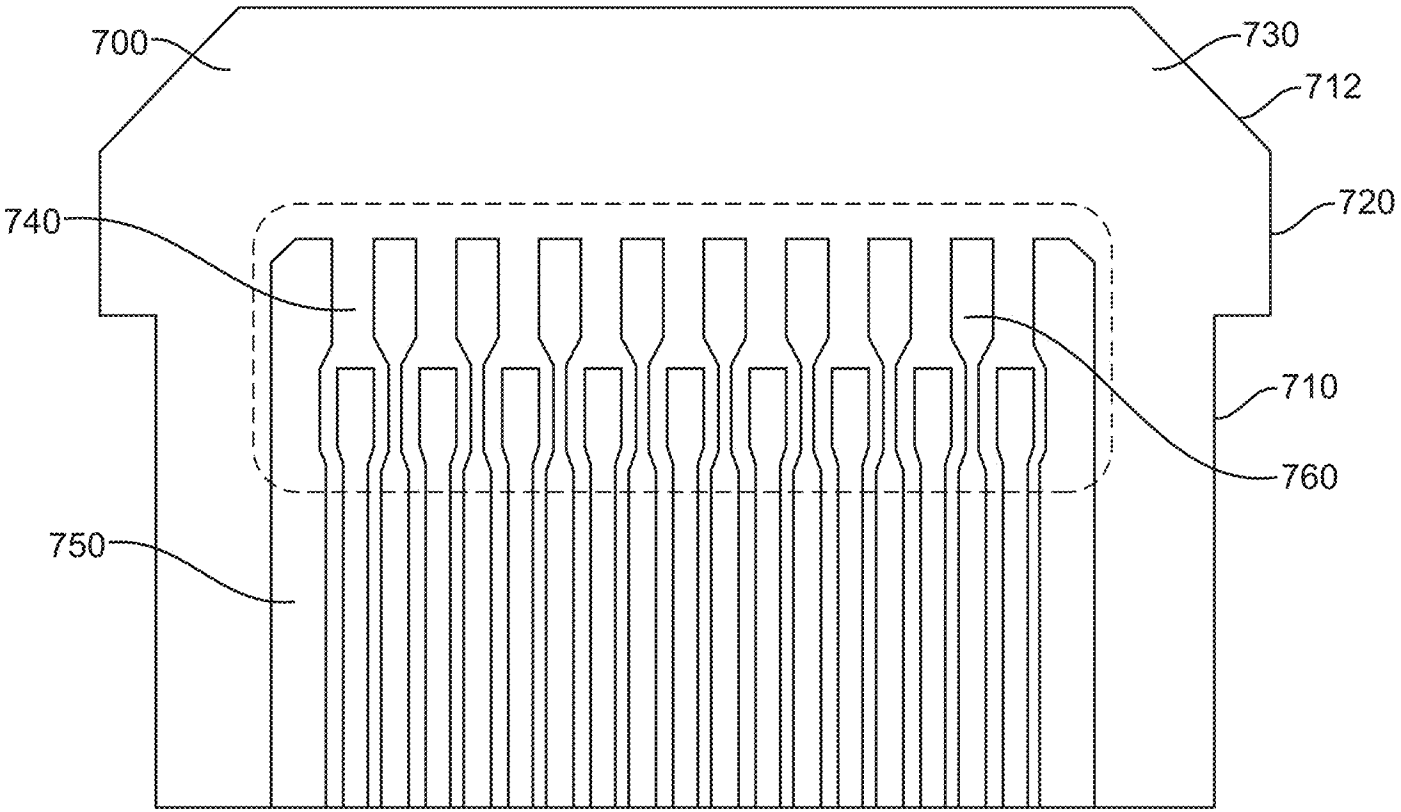
FIG. 7 illustrates a bottom surface of a flexible circuit board that can be mated with a connector according to an embodiment of the present invention.

FIG. 7 illustrates a bottom surface of a flexible circuit board that can be mated with a connector according to an embodiment of the present invention. In this example, flexible circuit board 700 can include an area 730 having a protective or coverlay region surrounding an area 740, where the protective layer or coverlay is absent. Traces 750 can connect to circuitry or components (not shown) in an electronic device (not shown) housing connector 10 (shown in FIG. 1.) Traces 750 can further connect to contacts 760. Contacts 760 can physically and electrically connect to contacting portions 210 of contacts 200 (both shown in FIG. 4) of connector 10. Flexible circuit board 700 can include one or more features, such as cutouts 710 or cutouts 712. Cutouts 710 and cutouts 712 can align with alignment features, such as alignment feature 120 and alignment feature 122 on a top surface of housing 100 (all shown in FIG. 1) of connector 10.

The various possible moisture ingress paths for a connector according to an embodiment of the present invention can be protected in various ways. Examples are shown in the following figure.

Figure 8:
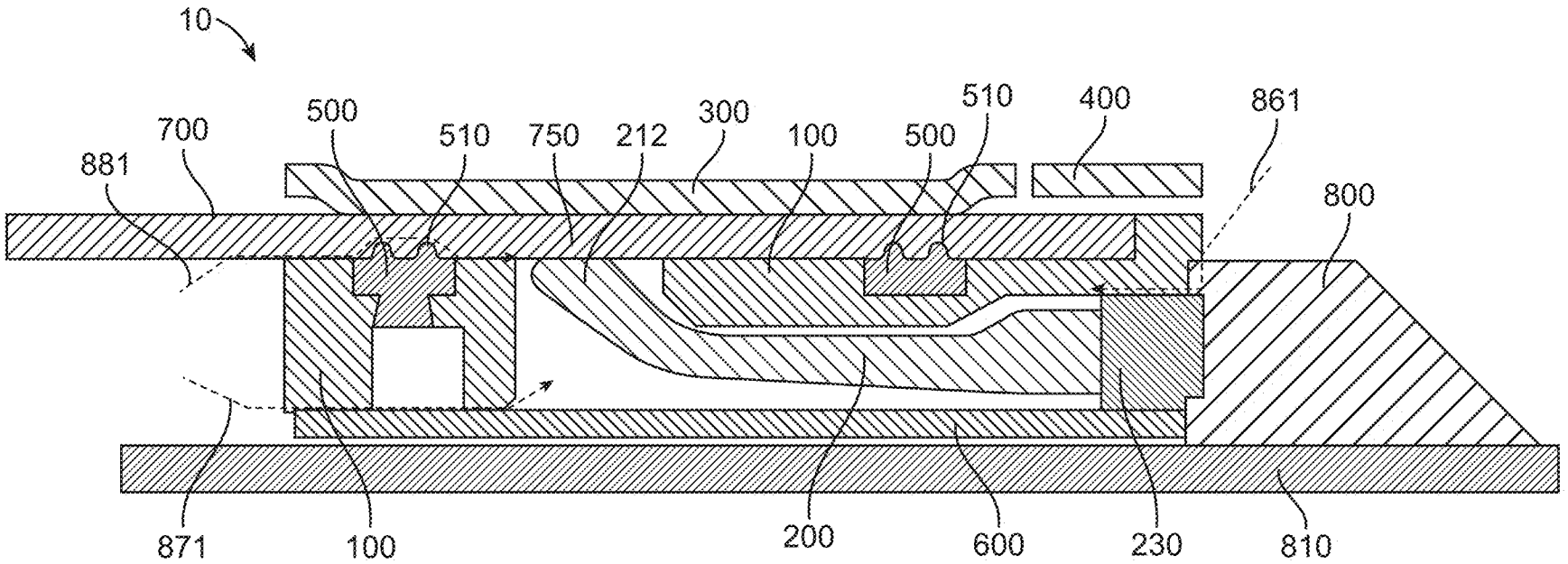
FIG. 8 illustrates a cutaway side view of a connector according to an embodiment of the present invention.

FIG. 8 illustrates a cutaway side view of a connector according to an embodiment of the present invention. In this example, connector 10 can be mated with flexible circuit board 700 to provide a connection between traces (not shown) of flexible circuit board 700 and traces (not shown) of printed circuit board 810. Specifically, traces of flexible circuit board 700 can connect to contacts 760 on an underside of flexible circuit board 700. Contacts 760 can physically and electrically connect to contacting portions 212 of contacts 200. Contacts 200 can physically and electrically connect to pads 820 (shown in FIG. 6) of printed circuit board 810 through surface-mount contacting portions 220 (shown in FIG. 6.) Cover 300 can hold flexible circuit board 700 in place. Shell 400 can provide shielding for connector 10.

A first ingress path 861 between housing 230 and housing 100 can be blocked by potting material 800. A second ingress path 871 between housing 100 and bottom cover 600 can be blocked by adhesive or other material (not shown). This adhesive can be a die-cut adhesive. Alternatively, ultrasonic welding, laser welding, or other technique can be used to join housing 100 to bottom cover 600. A third ingress path 881 between housing 100 and flexible circuit board 700 can be blocked by gasket 500, including ribs 510. In this way, contacts 200 can be protected from moisture that can be located inside an electronic device (not shown) housing connector 10.

Figure 9:
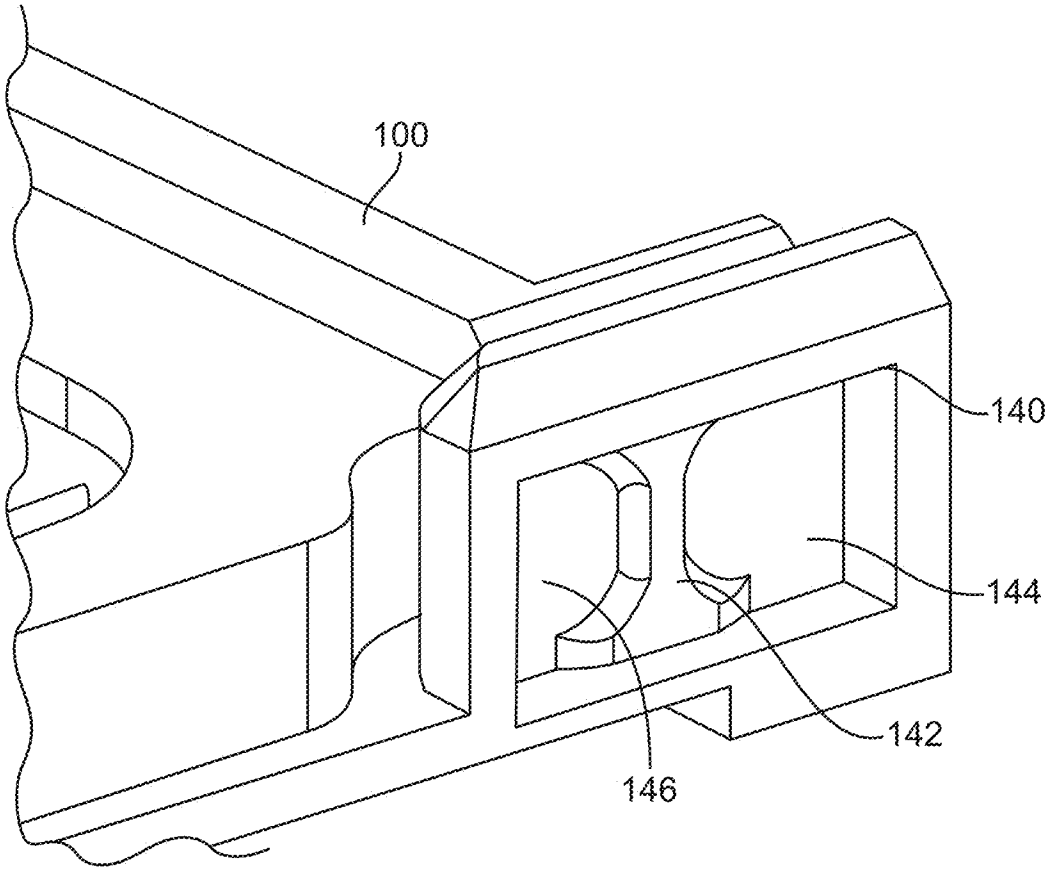
FIG. 9 illustrates details of a housing for the connector of FIG. 1.

FIG. 9 illustrates details of a housing for the connector of FIG. 1. Housing 100 can include detent 140. Detent 140 can include forward recess 146 and rear recess 144. Forward recess 146 and rear recess 144 can be separated by raised portion 142. Raised portion 142 can tend to drive dimple 340 of cover 300 (both shown in FIG. 1) into either forward recess 146 or rear recess 144. When dimple 340 is in forward recess 146, cover 300 can be rotated or pivoted relative to housing 100. When dimple 340 is located in rear recess 144, cover 300 can be locked relative to housing 100 using the methods shown above.

Figure 10:
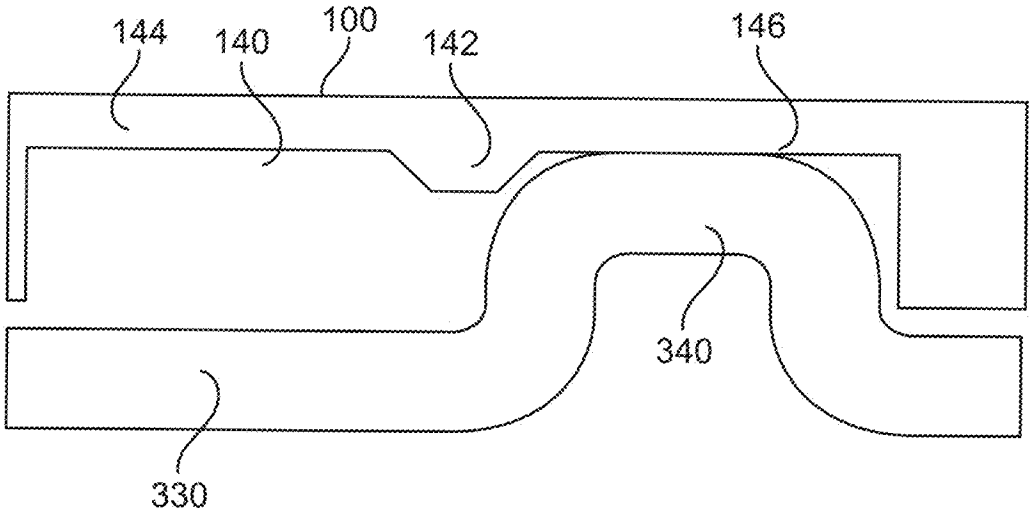
FIG. 10 illustrates a detail of the connector of FIG. 1.

FIG. 10 illustrates a detail of the connector of FIG. 1. Cover 300 (shown in FIG. 1) can include arm 330 terminating in dimple 340. Dimple 340 can be located in detent 140 in a side of housing 100. Detent 140 can include rear recess 144 and forward recess 146 separated by raised portion 142. In these and other embodiments of the present invention, arms 330 can be preloaded to increase a force of dimple 340 in detent 140. This can increase an amount of force needed to move cover 300 (shown in FIG. 1) relative to housing 100.

Again, in these and other embodiments the present invention, a cover can be locked relative to a housing using a tab that can fit in a slot in a fork of a shell. Alternatively, the fork can be replaced with a single prong, under which the tab can fit when the cover is locked. The tab can have various shapes, and these shapes can be varied to adjust a hold force provided by the tabs, where the hold force keeps the cover locked in place against the housing.

Also, these connectors, and the electronic devices (not shown) that house them, can be dropped or otherwise subjected to a fall. Such as fall can exert a force in an upward direction on a locked cover. It can be desirable that this upward force be insufficient to open the connector. By changing these tabs, the force necessary to inadvertently open the connector can be increased. Examples are shown in the following figures.

Figure 11:
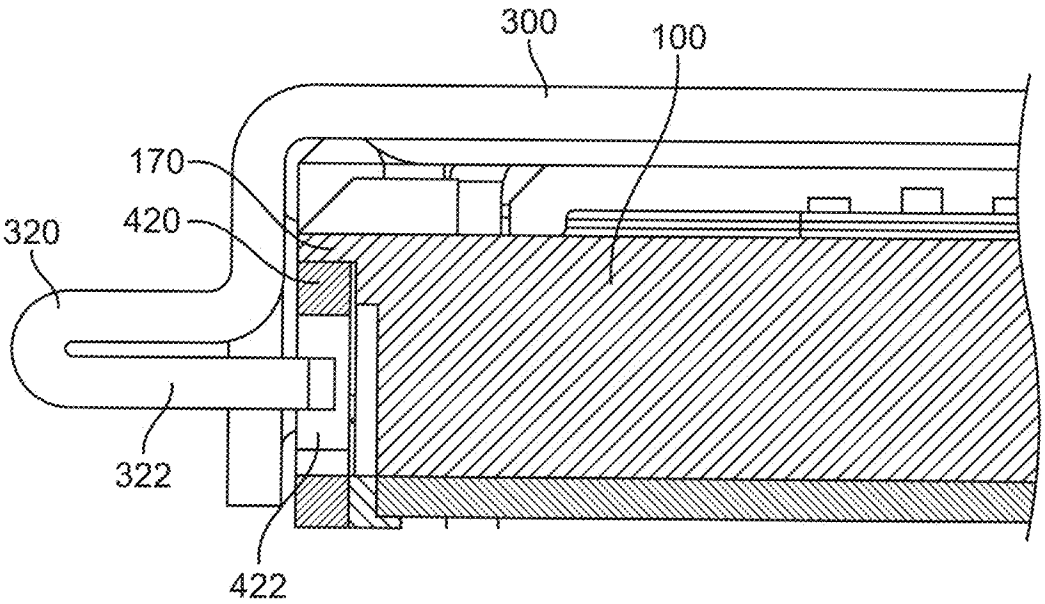
FIG. 11 illustrates a cutaway view of a tab and related features of a connector according to an embodiment of the present invention.

FIG. 11 illustrates a cutaway view of a tab and related features of a connector according to an embodiment of the present invention. In this example, cover 300 can include tab 320 having locking portion 322. Locking portion 322 can fit in slot 422 of fork 420. Fork 420 can be reinforced by portion 170 of housing 100. In this example, cover 300 can be opened if pulled straight up only when enough force is provided that locking portion 322 is bent around fork 420. This necessary force can be increased by changing shape of locking portion 322. An example is shown in the following figure.

Figure 12:
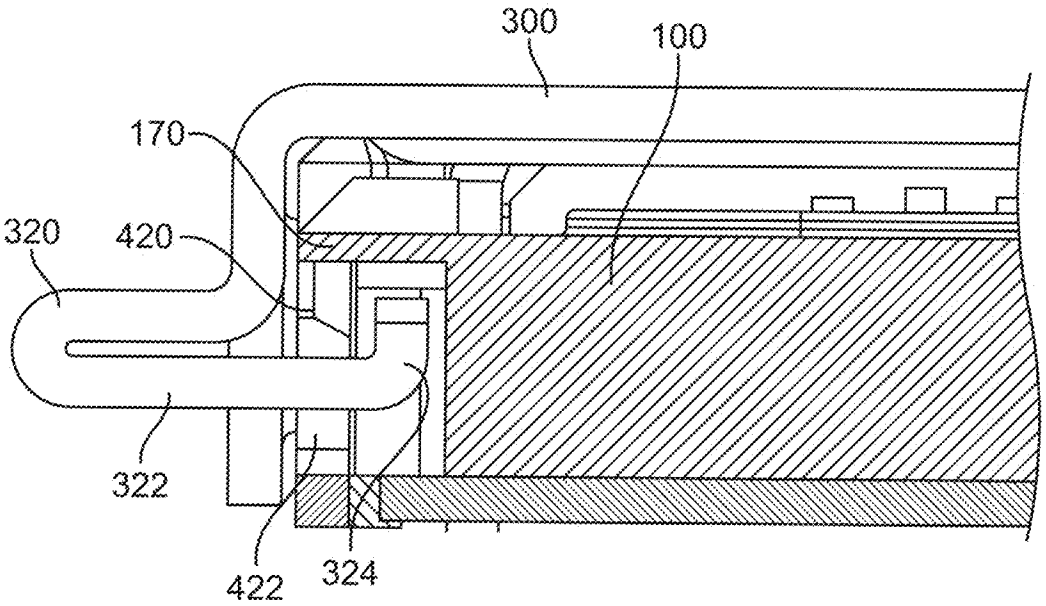
FIG. 12 illustrates a cutaway view of a tab and related feature of a connector according to an embodiment of the present invention.

FIG. 12 illustrates a cutaway view of a tab and related feature of a connector according to an embodiment of the present invention. In this example, cover 300 can include tab 320 having locking portion 322, where the locking feature now includes an upright portion 324. As before, locking portion 322 can fit in slot 422 of fork 420. Fork 420 can be reinforced by portion 170 of housing 100. In this example, cover 300 can be opened if pulled straight up only when enough force is provided that upright portion 324 of locking portion 322 is bent around fork 420. The necessary force for this can be much higher than when upright portion 324 is absent, such as in the previous figure. It should be noted that this is not a typical opening procedure but instead is an event that typically only occurs during a fall event.

These and other embodiments of the present invention can provide variations of connector 10 (shown in FIG. 1) and connector 20 (shown in FIG. 5.) These variations can include features to improve grounding, flexible circuit board retention, water resistance, and others. These variations can also enable more than one flexible circuit board to be connected to a printed circuit board. Examples are shown in the following figures.

Figure 13:
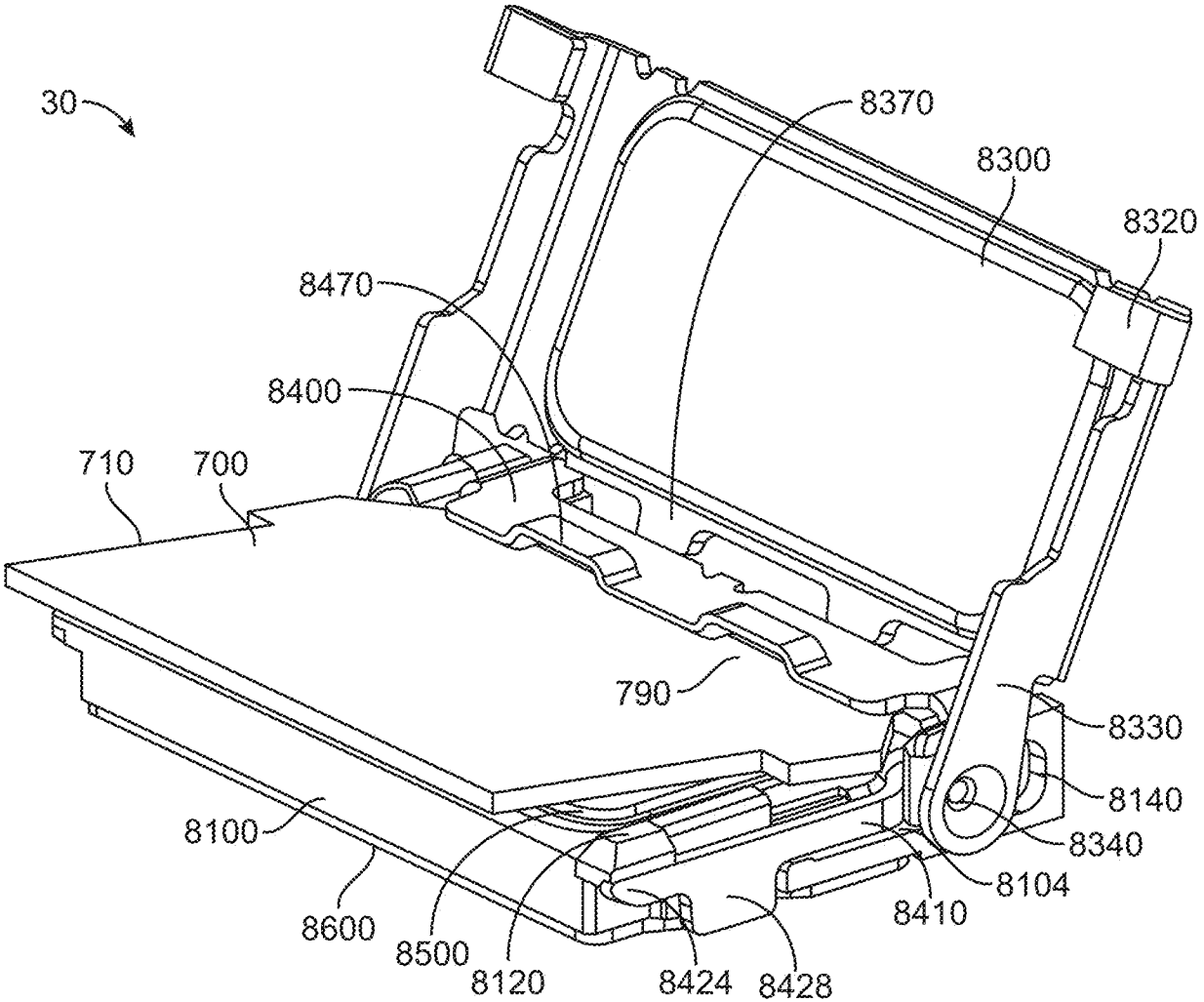
FIG. 13 illustrates a connector according to an embodiment of the present invention.

FIG. 13 illustrates a connector according to an embodiment of the present invention. Connector 30 can be a variation of connector 10 (shown in FIG. 1) or connector 20 (shown in FIG. 5.) Connector 30 can include housing 8100 supported by bottom cover 8600. Shell 8400 can include arms 8410 that terminate in prongs 8424. Arms 8410 can be located in slots 8104 in sides of housing 8100. Flexible circuit board 700 can include notches and other cutouts 710 that can align with features 8120 on a top surface of housing 8100. Cover 8300 can include tabs 8320 and arms 8330 that terminate in pivot structures, shown here as dimples 8340. Dimples 8340 can be located in detents 8140. Detents 8140 can be the same or similar as detents 140 in FIG. 9.

Connector 30 can provide improved grounding. For example, arms 8410 of shell 8400 can include tabs 8428. Tabs 8428 can be soldered to pads or contacts (not shown) on a top surface of printed circuit board 810 (shown in FIG. 6.)

In this and other embodiments of the present invention, a front edge 790 of flexible circuit board 700 can fit under shell 8400. This can help to retain flexible circuit board 700 in place when a connection using connector 30 is made. That is, fitting front edge 790 of flexible circuit board 700 under shell 8400 can help to secure flexible circuit board 700 in place as cover 8300 is closed and then locked. Extensions 8370 of cover 8300 can fit under raised portions 8470 of shell 8400. This can help to secure cover 8300 in place relative to housing 8100.

Inserting extensions 8370 under raised portions 8470 can increase a force applied by cover 8300 to flexible circuit board 700. This can also more evenly distribute a force applied by cover 8300 to an interface between flexible circuit board 700 and gasket 8500. This in turn can further improve the moisture resistance of connector 30.

Figure 14:
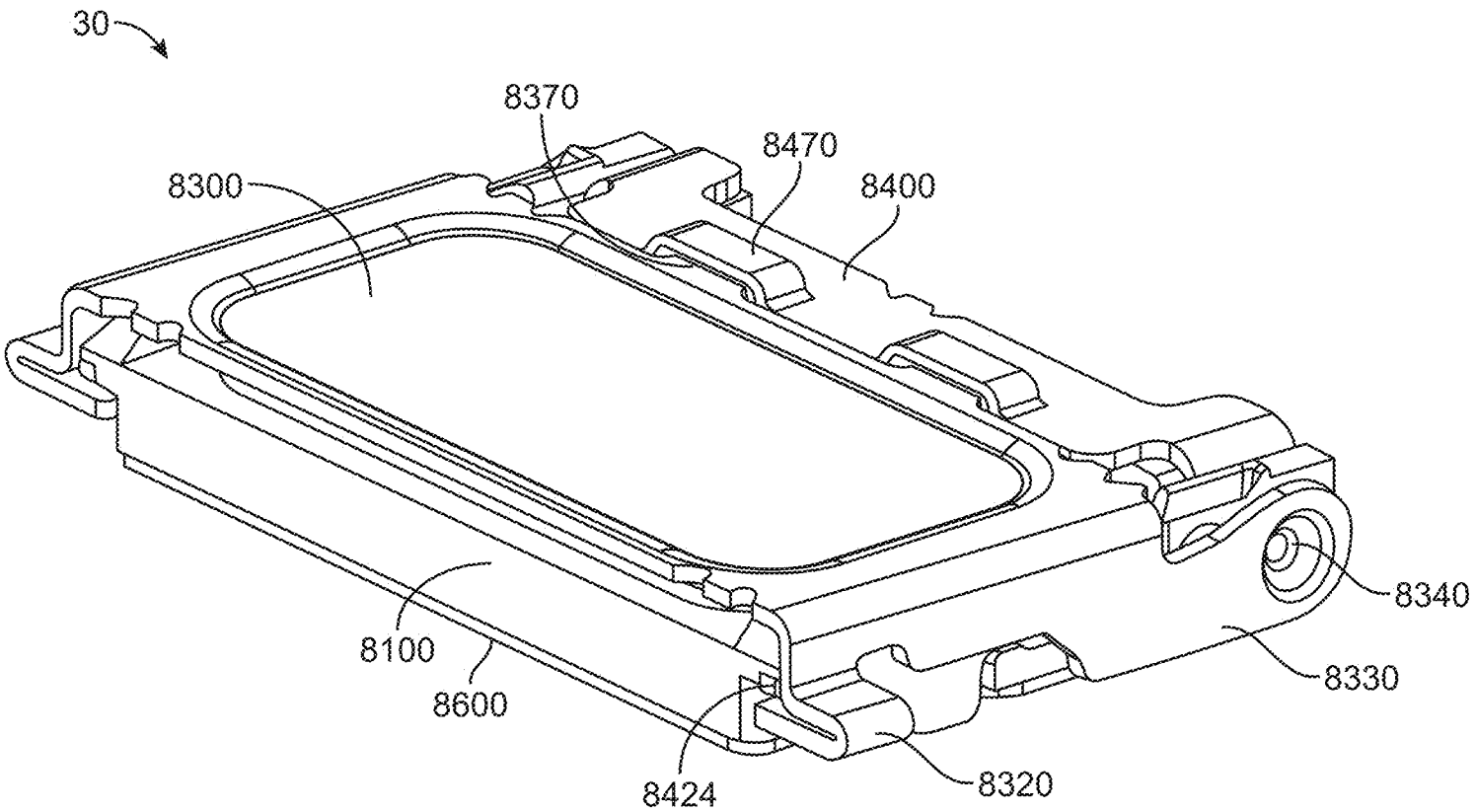
FIG. 14 illustrates the connector of FIG. 13 in a closed and locked position.

FIG. 14 illustrates the connector of FIG. 13 in a locked position. In this example, flexible circuit board 700 (shown in FIG. 13) has been removed for clarity. Cover 8300 of connector 30 can be closed or laid flat against a top surface of housing 8100. Bottom cover 8600 can support housing 8100. When cover 8300 is moved backward relative to housing 8100, tabs 8320 can fit under prongs 8424. Dimples 8340 can fit in a rear portion of detent 8140 (shown in FIG. 13) in housing 8100. Also, extensions 8370 can fit under raised portions 8470. The interlocking features of extensions 8370 and raised portions 8470 can help to secure flexible circuit board 700 in place when connector 40 is locked.

In these and other embodiments of the present invention, it can be desirable to connect multiple flexible circuit boards to a printed circuit board. An example of such a connector is shown in the following figures.

Figure 15:
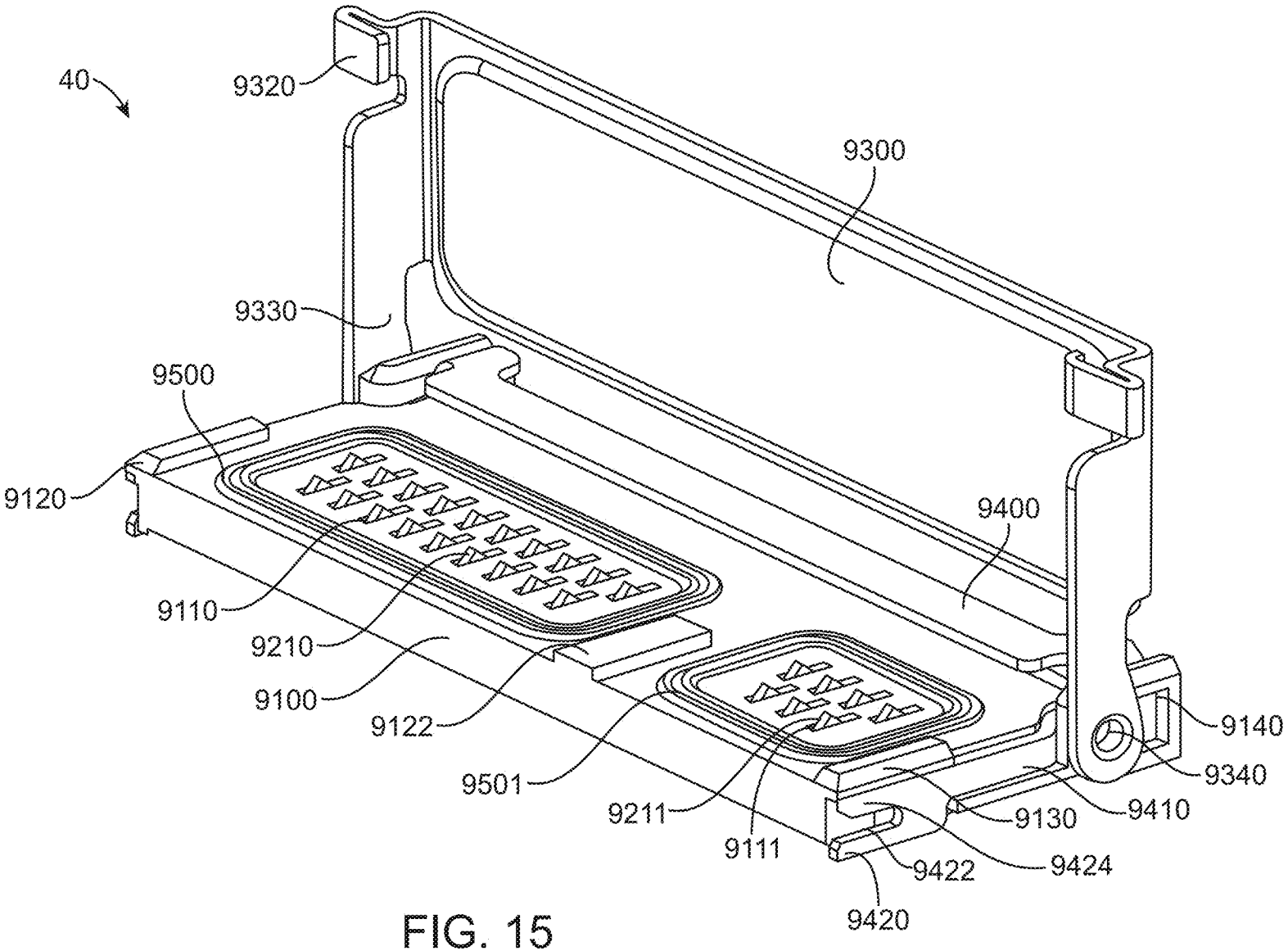
FIG. 15 illustrates a connector for connecting multiple flexible circuit boards to a printed circuit board according to an embodiment of the present invention.

FIG. 15 illustrates a connector for connecting multiple flexible circuit boards to a printed circuit board according to an embodiment of the present invention. Connector 40 can be similar to connector 10 (shown in FIG. 1), connector 20 (shown in FIG. 5), or connector 30 (shown in FIG. 13.) In this example, connector 40 can include housing 9100. Housing 9100 can include openings 9110 for contacting portions 9210 of a first set of contacts (not shown) and openings 9111 for contacting portions 9211 of a second set of contacts (not shown.) Contacting portions 9210 can be laterally surrounded by gasket 9500, while contacting portions 9211 can be laterally surrounded by gasket 9501. Alignment features 9120, 9122, and 9130 can be used to align flexible circuit boards to connector 30. Cover 9300 can include tabs 9320 and arms 9330. Arms 9330 can terminate in pivoting structures, shown here as dimples 9340. Dimples 9340 can reside in detent 9140 in sides of housing 9100. Shell 9400 can include arms 9410, which can terminate in forks 9420. Forks 9420 can include slots 9422 and prongs 9424. That is, arms 9410 can terminate in prongs 9424.

Figure 16:
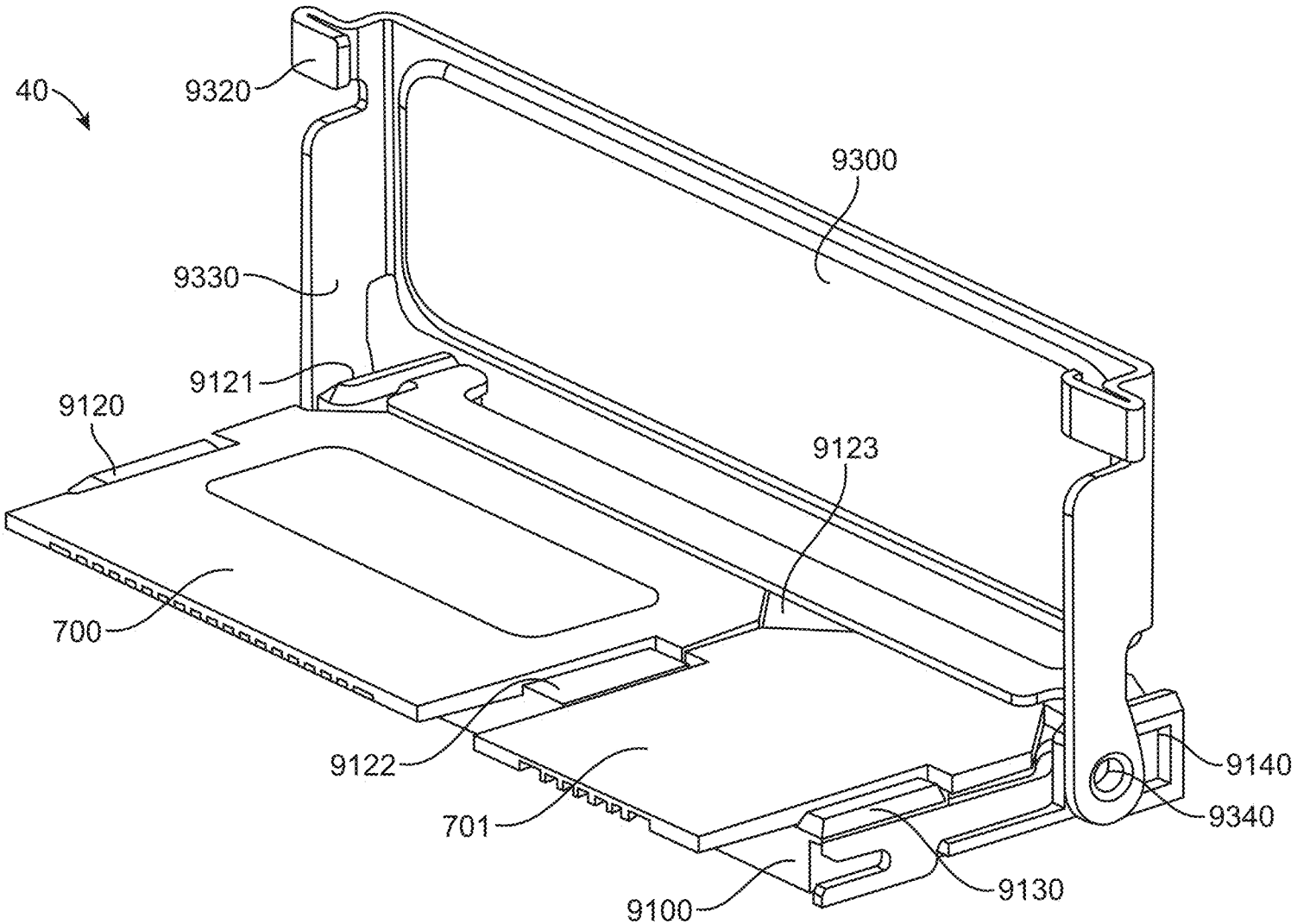
FIG. 16 illustrates the connector of FIG. 15 where multiple flexible circuit boards are being connected.

FIG. 16 illustrates the connector of FIG. 15 where multiple flexible circuit boards are being connected. Specifically, flexible circuit board 700 and flexible circuit board 701 can be placed on a top surface of housing 9100. Alignment feature 9120, alignment feature 9122, alignment feature 9130, alignment feature 9121, and alignment feature 9123 can be used to align flexible circuit board 700 and flexible circuit board 701 to housing 9100. As before, this can ensure that contacts 760 (shown in FIG. 7) accurately alignment with, and physically and electronically connect to, contacting portions 9210 and contacting portions 9011 (both shown in FIG. 13.) As before, cover 9300 can include tabs 9320 and arms 9330, and arms 9330 can terminate in dimples 9340. Dimples 9340 can reside in detents 9140 in sides of housing 9100 of connector 40.

Figure 17:
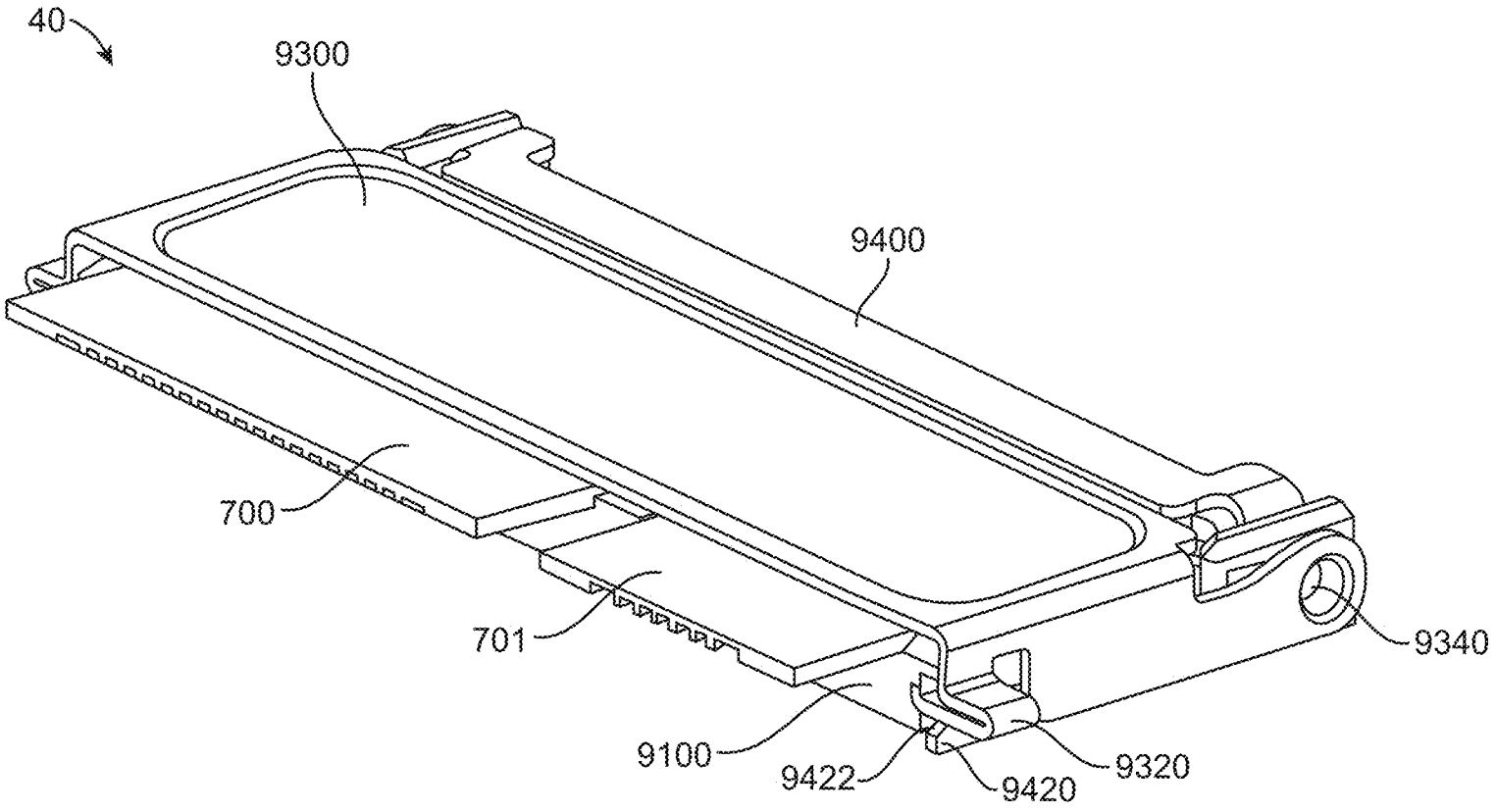
FIG. 17 illustrates the connector of FIG. 15 in a closed and locked position.

FIG. 17 illustrates the connector of FIG. 15 in a closed and locked position. In this configuration, flexible circuit board 700 and flexible circuit board 701 can be held in place and locked by cover 9300 into position relative to housing 9100 of connector 40. Tabs 9320 of cover 9300 can be fit in slots 9422 of forks 9420. Dimples 9340 can be located in a rear recess similar to rear recess 144 (shown in FIG. 9) of detent 9140 (shown in FIG. 14) in housing 9100.

In these and other embodiments of the present invention, contacts, shells, covers, and other conductive portions of a connector can be formed by stamping, metal-injection molding, machining, micro-machining, 3-D printing, forging, drawing, or other manufacturing process. The conductive portions can be formed of stainless steel, steel, copper, copper titanium, phosphor bronze, or other material or combination of materials. They can be plated or coated with nickel, gold, or other material. The nonconductive portions, such as the housings, can be formed using injection or other molding, 3-D printing, machining, or other manufacturing process. The nonconductive portions can be formed of silicon or silicone, rubber, hard rubber, plastic, nylon, liquid-crystal polymers (LCPs), or other nonconductive material or combination of materials.

These and other embodiments of the present invention can provide connectors that can be located in various types of devices, such as portable computing devices, tablet computers, desktop computers, laptops, all-in-one computers, cell phones, wearable-computing devices, storage devices, portable media players, navigation systems, monitors, power supplies, adapters, remote control devices, audio devices, chargers, and other devices. These connectors can provide pathways for signals that are compliant with various standards such as Universal Serial Bus (USB), a High-Definition Multimedia Interface (HDMI), Digital Visual Interface (DVI), power, Ethernet, DisplayPort, Thunderbolt, Lightning and other types of standard and non-standard interfaces that have been developed, are being developed, or will be developed in the future.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector comprising:

a plurality of contacts, each having a contacting portion at a first end;

a housing having a top surface, the top surface having one or more openings, the contacting portion for each of the plurality of contacts extending through the one or more openings and above the top surface;

a gasket on the top surface of the housing and laterally surrounding the one or more openings in the top surface;

a shell having a first arm extending along a first side and a second arm extending along a second side, the first arm terminating in a first prong, the second arm terminating in a second prong, the first prong and the second prong near a front of the connector, the shell further comprising a first raised portion; and a cover having a first arm, the first arm having a first dimple to fit in a first detent on a first side of the housing and a second arm, the second arm having a second dimple to fit in a second detent on the second side of the housing, the cover further having a first tab to fit under the first prong of the shell when the cover is in a locked position and a second tab to fit under the second prong of the shell when the cover is in the locked position, the cover further having a first extension to fit under the first raised portion when the cover is in the locked position.

2. The connector of claim 1 wherein the housing further comprises a plurality of alignment features extending above the top surface of the housing.

3. The connector claim 2 wherein the first detent and the second detent are near a back of the housing.

4. The connector of claim 3 wherein the one or more openings in the top surface comprising a plurality of openings, wherein each contacting portion for each of the plurality of contacts extends through a corresponding opening in the plurality of openings.

5. The connector of claim 4 wherein each of the plurality of contacts further comprises a surface-mount contacting portion at a second end.

6. The connector of claim 5 wherein the gasket is located in a groove in the top surface of the housing.

7. The connector of claim 6 wherein the gasket comprises a plurality of ribs.

8. The connector of claim 1 wherein the shell further comprises a second raised portion and the cover further comprises a second extension to fit under the second raised portion when the cover is in the locked position.

9. The connector of claim 8 wherein the housing further comprises alignment features on the top surface to align a flexible circuit board when the flexible circuit board is mated with the connector.

10. A connector comprising:

a plurality of contacts, each having a contacting portion at a first end;

a housing having a top surface, the top surface having one or more openings, the contacting portion for each of the plurality of contacts extending through the one or more openings and above the top surface;

a gasket on the top surface of the housing and laterally surrounding the one or more openings in the top surface;

a shell having a first arm extending along a first side and a second arm extending along a second side, the first arm terminating in a first prong, the second arm terminating in a second prong, the shell further comprising a first raised portion; and a cover having a first arm, the first arm having a first pivot structure, and a second arm, the second arm having a second pivot structure, wherein the first pivot structure and the second pivot structure allow the cover to rotate relative to the housing, the cover further having a first tab to fit under the first prong of the shell when the cover is in a locked position and a second tab to fit under the second prong of the shell when the cover is in the locked position, the cover further having a first extension to fit under the first raised portion when the cover is in the locked position.

11. The connector of claim 10 wherein the gasket is located in a groove in the top surface of the housing.

12. The connector of claim 11 wherein the gasket comprises a plurality of ribs.

13. The connector of claim 12 wherein the first arm of the cover terminates in a first fork, the first fork comprising the first prong, a third prong, and a first slot between the first prong and the third prong, and wherein the second arm of the cover terminates in a second fork, the second fork comprising the second prong, a fourth prong, and a second slot between the second prong and the fourth prong.

14. The connector of claim 13 wherein the first pivot structure is a first dimple and the second pivot structure is a second dimple.

15. The connector of claim 14 wherein the first dimple fits in a first detent in the first side of the housing and the second dimple fits in a second detent in the second side of the housing.

16. The connector of claim 15 wherein the cover slides towards a front of the housing to move to an unlocked position, and wherein when the cover slides towards the front of the housing, the first dimple moves forward in the first detent and the second dimple moves forward in the second detent.

17. The connector of claim 10 wherein the shell further comprises a second raised portion and the cover further comprises a second extension to fit under the second raised portion when the cover is in the locked position.

18. The connector of claim 17 wherein the housing further comprises alignment features on the top surface to align a flexible circuit board when the flexible circuit board is mated with the connector.

19. A connector comprising:

a first plurality of contacts, each having a contacting portion at a first end;

a second plurality of contacts, each having a contacting portion at a first end;

a housing having a top surface, the top surface having one or more first openings, the contacting portion for each of the first plurality of contacts extending through the one or more first openings and above the top surface, the top surface further having one or more second openings, the contacting portion for each of the second plurality of contacts extending through the one or more second openings and above the top surface;

a first gasket on the top surface of the housing and laterally surrounding the one or more first openings in the top surface;

a second gasket on the top surface of the housing and laterally surrounding the one or more second openings in the top surface;

a shell having a first arm extending along a first side and a second arm extending along a second side, the first arm terminating in a first prong, the second arm terminating in a second prong, the first prong and the second prong near a front of the connector; and a cover having a first arm, the first arm having a first pivot structure, and a second arm, the second arm having a second pivot structure, wherein the first pivot structure and the second pivot structure allow the cover to rotate relative to the housing, the cover further having a first tab to fit under the first prong of the shell when the cover is in a locked position and a second tab to fit under the second prong of the shell when the cover is in the locked position, wherein the first pivot structure is a first dimple and the second pivot structure is a second dimple.

20. The connector of claim 19 wherein the shell further comprises a first raised portion and a second raised portion, and the cover further comprises a first extension to fit under the first raised portion and a second extension to fit under the second raised portion when the cover is in the locked position.

21. The connector of claim 19 wherein the first dimple fits in a first detent in the first side of the housing and the second dimple fits in a second detent in the second side of the housing.

22. The connector of claim 21 wherein the cover slides towards the front of the housing to move to an unlocked position.

23. The connector of claim 22 wherein when the cover slides towards the front of the housing, the first dimple moves forward in the first detent and the second dimple moves forward in the second detent.

24. The connector of claim 23 wherein the first arm of the cover terminates in a first fork, the first fork comprising the first prong, a third prong, and a first slot between the first prong and the third prong, and wherein the second arm of the cover terminates in a second fork, the second fork comprising the second prong, a fourth prong, and a second slot between the second prong and the fourth prong.

* * * * *